US010925136B2

(12) United States Patent
Xing et al.

(10) Patent No.: US 10,925,136 B2
(45) Date of Patent: Feb. 16, 2021

(54) LIGHTING APPARATUS, DRIVING CIRCUIT AND DRIVING METHOD THEREOF

(71) Applicant: GENERAL ELECTRIC COMPANY, Schenectady, NY (US)

(72) Inventors: Dong Xing, Shanghai (CN); Xin Zhou, Shanghai (CN); Charles Shi, Shanghai (CN); Jiyong Zhang, Shanghai (CN); Fanbin Wang, Shanghai (CN)

(73) Assignee: Savant Technologies LLC, East Cleveland, OH (US)

( * ) Notice: Subject to any disclaimer, the term of this patent is extended or adjusted under 35 U.S.C. 154(b) by 0 days.

(21) Appl. No.: 16/639,119

(22) PCT Filed: Aug. 15, 2017

(86) PCT No.: PCT/CN2017/097503

§ 371 (c)(1),
(2) Date: Feb. 13, 2020

(87) PCT Pub. No.: WO2019/033265

PCT Pub. Date: Feb. 21, 2019

(65) Prior Publication Data

US 2020/0214104 A1 Jul. 2, 2020

(51) Int. Cl.
*H05B 45/325* (2020.01)
*H05B 45/20* (2020.01)
*H05B 45/37* (2020.01)

(52) U.S. Cl.
CPC ..... *H05B 45/325* (2020.01); *H05B 45/20* (2020.01); *H05B 45/37* (2020.01)

(58) Field of Classification Search
CPC ..... H05B 45/325; H05B 45/37; H05B 45/20
See application file for complete search history.

(56) References Cited

U.S. PATENT DOCUMENTS 6,008,833 A * 12/1999 Ohtsubo ..... B41J 2/525 347/148
8,896,214 B2 * 11/2014 Xu ..... H02M 3/1588 315/122

(Continued)

FOREIGN PATENT DOCUMENTS

CN 1158042 A 8/1997
CN 101770748 A 7/2010

(Continued)

OTHER PUBLICATIONS

International Search Report and the Written Opinion of the International Searching Authority from International Appl. No. PCT/CN2017/097503, dated May 31, 2018.

*Primary Examiner* — Daniel D Chang
(74) *Attorney, Agent, or Firm* — Wood IP LLC

(57) ABSTRACT

The present disclosure relates to a lighting apparatus, a driving circuit and driving method thereof. The lighting apparatus comprises a plurality groups of lighting elements and a driving circuit. Each group of lighting elements comprises at least one lighting element, each lighting element in a same group having a cathode connected to a common cathode node. The driving circuit comprises a plurality of voltage sources, each having a terminal connected to an anode of a respective lighting element in each group of lighting elements; and a plurality of current sources, each having a terminal connected to the common cathode node of a respective group of lighting elements.

20 Claims, 6 Drawing Sheets

(56) References Cited

U.S. PATENT DOCUMENTS

| | | | | |
|---|---|---|---|---|
| 2004/0207315 | A1* | 10/2004 | Robbie | H01L 27/3293 313/504 |
| 2011/0140618 | A1* | 6/2011 | Wang | H05B 45/40 315/193 |

FOREIGN PATENT DOCUMENTS

| | | | |
|---|---|---|---|
| CN | 101894504 | A | 11/2010 |
| CN | 202795924 | U | 3/2013 |
| CN | 203251829 | U | 6/2013 |
| CN | 203596162 | U | 5/2014 |
| CN | 104955247 | A | 9/2015 |
| CN | 107493635 | A | 12/2017 |
| JP | 56137687 | A | 10/1981 |
| WO | 2019/033265 | A1 | 2/2019 |

* cited by examiner

LIGHTING APPARATUS, DRIVING CIRCUIT AND DRIVING METHOD THEREOF

FIELD

The present disclosure relates generally to LED lighting. More specifically, the present disclosure relates generally to a lighting apparatus, a driving circuit and driving method utilizing LEDs as its lighting elements.

BACKGROUND

In recent years, apparatus and applications involving LEDs (Light Emitting Diodes) are getting more and more popular. LEDs emit more lumens per watt than incandescent light bulbs, and LEDs can emit light of an intended color without using any color filters as traditional lighting methods need. This is more efficient, environmentally friendly and can lower initial costs. Thus, LEDs became a most popular light source.

Commonly, LEDs are arranged as LED arrays for emitting light in different colors or different color temperature. By mixing different colored LEDs, such as a red LED, a green LED, a blue LED or an additional white LED, a variety of different colored light could be emitted from the LED arrays. Further, by mixing LEDs with different color temperatures, such as from several Kelvins to 2000 Kelvins, or even to 6500 Kelvins, a variety of different color temperatures can be provided.

In one conventional approach to implement an LED array, multiple LEDs are connected in series with one another in a string, and those LEDs may be driven at a regulated current. Specifically, a bypass switch may be used to selectively control current to a specific group of LEDs located within the string. This kind of driving circuit may be very complex to control. Also in one conventional approach to implement the LED arrays, all LEDs are connected in a parallel way, so that each LED receives respective voltage control and current control. These conventional LED arrays may be difficult to control, or has complex structure or uneven brightness.

Taking the LED arrays connected in series as an example, each LEDs connected in the same array may have different rated voltages, specifically, forward voltage (Vf) of every same color LED may be different, for example, a red LED, a green LED, and a blue LED have different Vf. Due to their different Vf, light un-balance happens once they are connected in series. Also, when taking manufacturing of LEDs into consideration, the rated voltages of the same colored LEDs may also have large variation range, for example, one lot of LEDs has rated value of 2.1 V, while the other lot of LEDs has rated value of 2.6 V. Thus, connecting those LEDs in series brings undesired luminance effect.

Thus, in the conventional LED arrays, the current of an LED series shall be constantly controlled. If not, LED arrays will show different lumen, colors or color temperatures.

Therefore, there exists a continuing need in the art for a more efficient, simpler and cost effective approach for controlling LED arrays.

Further, there exists a continuing need in the art to provide a precise control on both current and voltage of every LED with simpler driving circuits.

SUMMARY

In one embodiment, a lighting apparatus is provided. The lighting apparatus comprises: a plurality groups of lighting elements; and driving circuit, wherein each group of lighting elements comprises at least one lighting element, each lighting element in a same group having a cathode connected to a common cathode node, the driving circuit comprises: a plurality of voltage sources, each having a terminal connected to an anode of a respective lighting element in each group of lighting elements; and a plurality of current sources, each having a terminal connected to the common cathode node of a respective group of lighting elements.

In another embodiment, a driving circuit for a lighting apparatus is provided. The lighting apparatus comprises a plurality groups of lighting elements, each group of lighting elements comprising at least one lighting element, each lighting element in a same group having a cathode connected to a common cathode node. The driving circuit comprises: a plurality of voltage sources, each having a terminal connected to an anode of a respective lighting element in each group of lighting elements; and a plurality of current sources, each having a terminal connected to the common cathode node of a respective group of lighting elements.

In yet another embodiment, a driving method used for a lighting apparatus is provided. The lighting apparatus comprises a plurality groups of lighting elements and a driving circuit, each group of lighting elements comprising at least one lighting element, each lighting element in a same group having a cathode connected to a common cathode node. The driving circuit comprises a plurality of voltage sources and a plurality of current sources, each of the plurality of voltage sources having a terminal connected to an anode of a respective lighting element in each group of lighting elements, each of the plurality of current sources having a terminal connected to the common cathode node of a respective group of lighting elements. The driving method comprises: providing a constant voltage by each of the plurality of voltage sources; providing a constant current by each of the plurality of current sources; and turning on and off each current source to control a respective group of lighting elements.

BRIEF DESCRIPTION OF THE DRAWINGS

The present disclosure can be better understood in light of description of one embodiment of the present disclosure with reference to the accompanying drawings, in which.

DETAILED DESCRIPTION

Figure 1:
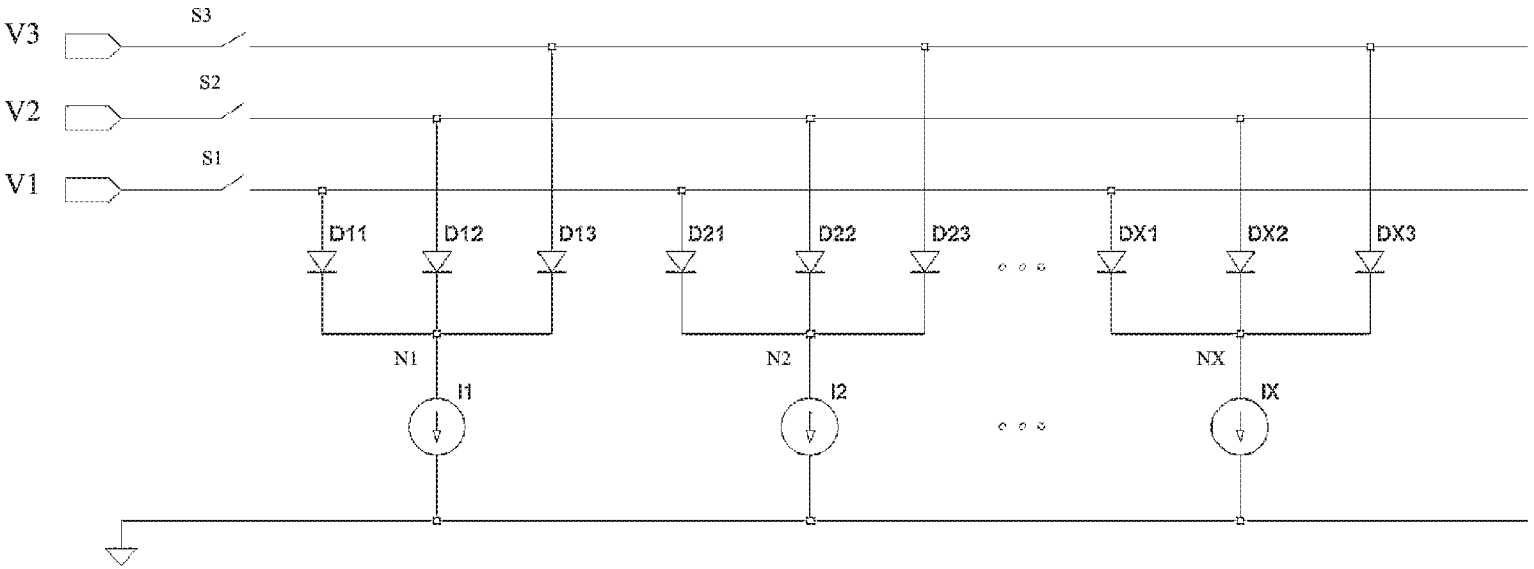
FIG. 1 illustrates an exemplary circuit diagram showing a structure of a lighting apparatus with a driver circuit and a plurality of LEDs.

Unless defined otherwise, the technical or scientific terms used herein should have the same meanings as commonly understood by one of ordinary skilled in the art to which the present disclosure belongs. The terms "first", "second" and the like in the Description and the Claims of the present application for disclosure do not mean any sequential order, number or importance, but are only used for distinguishing different components. Likewise, the terms "a", "an" and the like do not denote a limitation of quantity, but denote the existence of at least one. The terms "comprises", "comprising", "includes", "including" and the like mean that the element or object in front of the "comprises", "comprising", "includes" and "including" covers the elements or objects and their equivalents illustrated following the "comprises", "comprising", "includes" and "including", but do not exclude other elements or objects. The terms "coupled", "connected" and the like are not limited to being connected physically or mechanically, but may comprise electric connection, no matter directly or indirectly.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

The present disclosure relates to a light source, driving circuit and driving method thereof. Generally speaking, LEDs of the light source may be divided into a plurality of groups each containing several amounts of LEDs (such as three LEDs, i.e. red LED, green LED and blue LED). Each group of LEDs shares a common cathode. For example, a cathode of each LED in the same group of LEDs is connected to a common cathode node. The common cathode node is connected to a current source. An anode of each LED in the same group of LEDs is connected to a respective voltage source. With such a configuration, the driver circuit may provide a precise control on both current and voltage of every LED, and by controlling the current and voltage, the color (RGB) or CCT can be mixed and controlled. For example, the currents of the LEDs may be controlled on and off by group. In other words, the current is not controlled for every individual LEDs while the current of LEDs in the same group is controlled simultaneously. Detailed structure is discussed in following paragraphs by referring to FIG. 1.

FIG. 1 illustrates an exemplary circuit diagram showing a structure of a lighting apparatus with a driver circuit and a plurality of LEDs. In FIG. 1, three voltage sources V1, V2 and V3, three switches S1, S2 and S3, a plurality of current sources I1, I2, . . . IX, and a plurality of LEDs D11, D12, D13, D21, D22, D23, . . . , DX1, DX2 and DX3 are illustrated.

As shown in FIG. 1, a terminal of a first voltage source V1 is connected to anodes of LEDs D11, D21, . . . , and DX1. A terminal of a second voltage source V2 is connected to anodes of LEDs D12, D22, . . . , and DX2. A terminal of a third voltage source V3 is connected to anodes of LEDs D13, D23, . . . , and DX3. In some embodiments, the terminal of the first voltage source V1 is connected to the anodes of LEDs D11, D21, . . . , and DX1 through a switch S1. In some embodiments, the terminal of the second voltage source V2 is connected to the anodes of LEDs D12, D22, . . . , and DX2 through a switch S2. In some embodiments, the terminal of the third voltage source V3 is connected to the anodes of LEDs D13, D23, . . . , and DX3 through a switch S3.

In context of the present disclosure, "X" means a number equal to or more than three. "X" may be 3, 10, 15 . . . 55, etc, and "X" does not mean to limit the amount of elements. Any amount of required elements could be involved in this configuration. Also, the disclosure does not exclude any possible configuration, such as a configuration with only two groups of LEDs and two current sources may be involved in this disclosure.

Although FIG. 1 shows a structure with three voltage sources V1, V2, V3, in another embodiment, there could be four voltage sources, and a group of LEDs may comprise four LEDs, such as RGBW LEDs (red, green, blue, white LEDs). It should be understood that the disclosure does not aim to limit the amount of voltage sources or groups of LEDs.

Further with reference to FIG. 1, the cathodes of LEDs D11, D12 and D13 are connected to a first common cathode node N1. The cathodes of LEDs D21, D22 and D23 are connected to a second common cathode node N2. The cathodes of LEDs DX1, DX2 and DX3 are connected to a Xth common cathode node NX. The first common cathode node N1 is connected to a terminal of a first current source I1. The second common cathode node N2 is connected to a terminal of a second current source I2. The Xth common cathode node NX is connected to a terminal of a Xth current source IX.

As shown in FIG. 1, those LEDs sharing the same current source is designated as one group. In detail, the LEDs D11, D12 and D13 constitute a first group of LED array. The LEDs D21, D22 and D23 constitute a second group of LED array. The LEDs DX1, DX2 and DX3 constitute a Xth group of LED array. For example, the LEDs in one group may include a red LED, a green LED and a blue LED. Generally, a first LED D11 of the first group, a first LED D21 of the second group, a first LED DX1 of the Xth group are connected in a parallel way. A second LED D12 of the first group, a second LED D22 of the second group, a second LED DX2 of the Xth group are connected in a parallel way. A third LED D13 of the first group, a third LED D23 of the second group, a third LED DX3 of the Xth group are connected in a parallel way. In one embodiment, all the respective first LED in different groups may be a same type of LED, for example, D11, D21 and DX1 are red LEDs of a same type. In another embodiment, for example, D12, D22, . . . , and DX2 are green LEDs of a same type. In yet another embodiment, for example, D13, D23, . . . , and DX3 are blue LEDs of a same type. LEDs may be mixed in a variety of ways to implement different requirement of light output. For example, the light output may be a light color, or a color temperature.

Through parallel connection of the same type of LEDs in different groups, and by applying current source control in group unit, an even brightness, or simple structure, or lower cost may be achieved. Further, by controlling LEDs with current source in group unit, a function called lighting language can be implemented.

In a driver circuit according to one embodiment of the present disclosure, the voltage sources V1, V2 and V3 are constant voltage sources, and they can be connected to or disconnected from the anodes of LEDs through on and off of the switches S1, S2 and S3. The on and off controlling of the switches S1, S2 and S3 can be implemented by applying controlling signals such as pulse width modulated (PWM) signals. By controlling a shape, a duration or a frequency of PWM pulses, the light output of the LEDs may be controlled. The light output may be a light color, or a color temperature or brightness of a light.

In one embodiment, the LEDs in one group may have different variations of white light (e.g. a cool bright white, a warm yellow light), or may have different colors (e.g. red, green, blue, white). Therefore, the output light of one group of LEDs may be regulated by controlling the signals applied to the switches.

As another important circuit elements for driving the LEDs, a plurality of current sources I1, I2, . . . , IX are shown. A current value of each of the current sources is a constant value. Through applying current sources with a constant value, a maximum current value of each group of LEDs is limited, and thereby luminance evenness could be achieved.

Figure 2:
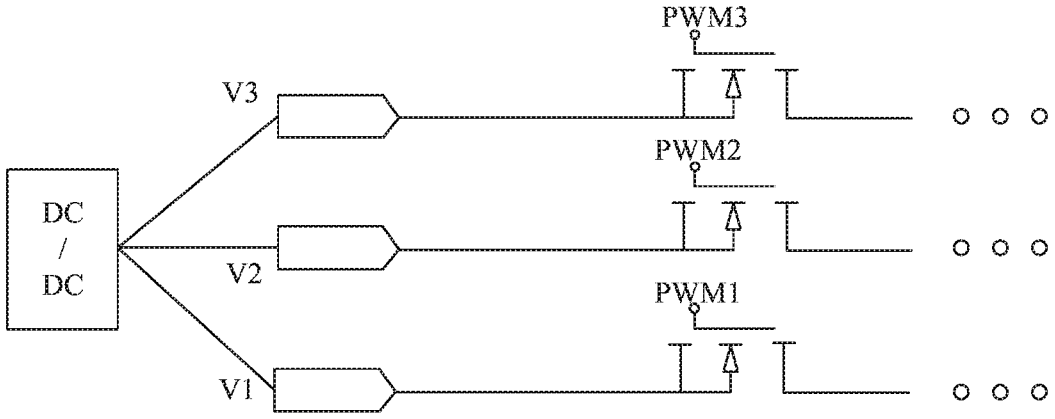
FIG. 2 illustrates an exemplary circuit diagram showing a portion of a voltage source connection according to one embodiment of the present disclosure.

FIG. 2 illustrates an exemplary circuit diagram showing a portion of the voltage source connection. With reference to FIG. 2, the voltage sources V1, V2 and V3 of the driver circuit are connected to direct current (DC) voltage sources such a DC/DC converter. In some embodiments, the output voltage value of the DC voltage source may be 2.6V. In some embodiments, the output voltage value of the DC voltage source may be 3.7V. These values are examples of voltage values, and they are not intended to limit the present disclosure inappropriately. DC voltages with other values can be involved in the present disclosure. There may be voltage with same value applied to terminals of the three voltages sources, or different voltages applied to the terminals of the three voltage sources respectively. In other words, the three constant voltage sources V1, V2 and V3 may have a same voltage value or have different voltage values. All of the voltage values which are suitable for controlling LEDs could be applied in the present disclosure.

Further, it can be seen that a switch connected between a terminal of the voltage source and an anode of a LED may be a PMOS. On and off of the PMOS may be achieved by PWM signals. The PWM signals may be applied from a PWM signal generator (not shown). By controlling a duration, a frequency or a pulse width of the PWM signals, different light output of LEDs can be achieved. In some embodiments, the LEDs are color LEDs, and thus a variety of different colors can be rendered. In some embodiments, the LEDs are correlated color temperature (CCT) LEDs, and thus a variety of color temperatures can be emitted.

Although a PMOS is shown as a switch for easy understanding, other types of transistors, elements functioning like switches can be used in the driving circuit. The disclosure does not aim to limit the switch type being used.

Figure 3:
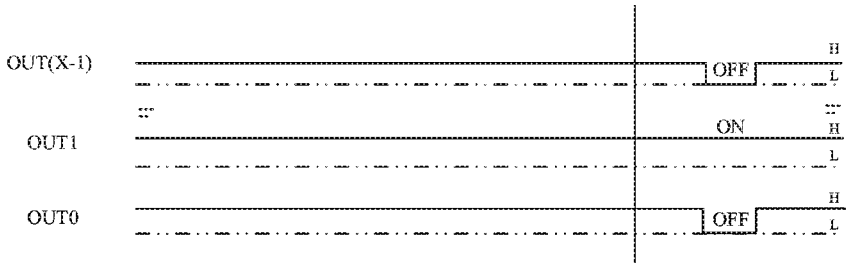
FIG. 3 illustrates exemplary control signals for controlling current sources of a driver circuit according to one embodiment of the present disclosure.

FIG. 3 illustrates exemplary control signals for controlling current sources of a driver circuit according to one embodiment of the present disclosure. In the sequence chart of control signals shown in FIG. 3, a control signal for each current source is designated as "OUTn", wherein "n" could be 0, 1, 2, . . . . , X−1. The signal "OUT0" represents a control signal for a first current source I1. The signal "OUT1" represents a control signal for a second current source I2. The signal "OUTX−1" represents a control signal for an X-th current source IX.

For easy understanding, in one embodiment of the disclosure, a lighting apparatus with sixteen current sources is discussed. When "X=16", a DSP module with sixteen output terminals (OUT0, OUT1, . . . , OUT15) could be used.

As shown in FIG. 3, when OUT1 is at high level, and OUT0 and OUTX−1 are at low level, the current source I2 of a second group of LEDs has current flowing through, while a first group and a Xth group of LEDs do not have current flowing through. In other words, the LEDs in the first group and the Xth group are turned off. A mode in which the current source is controlled on and off based on high level (H) and low level (L) of the control signal is called a Digital Signal Processing (DSP) control mode.

For virtue of easy understanding, an exemplary mode for controlling on and off of the current sources is further provided. Different appearances of the light apparatus when it is driven can be called as a "light language". When the light apparatus is made in a ring (circular) shape, the light apparatus can render appearance such as a timer, a clock by controlling on and off timing of each current source I1, I2, . . . , IX.

Figure 4:
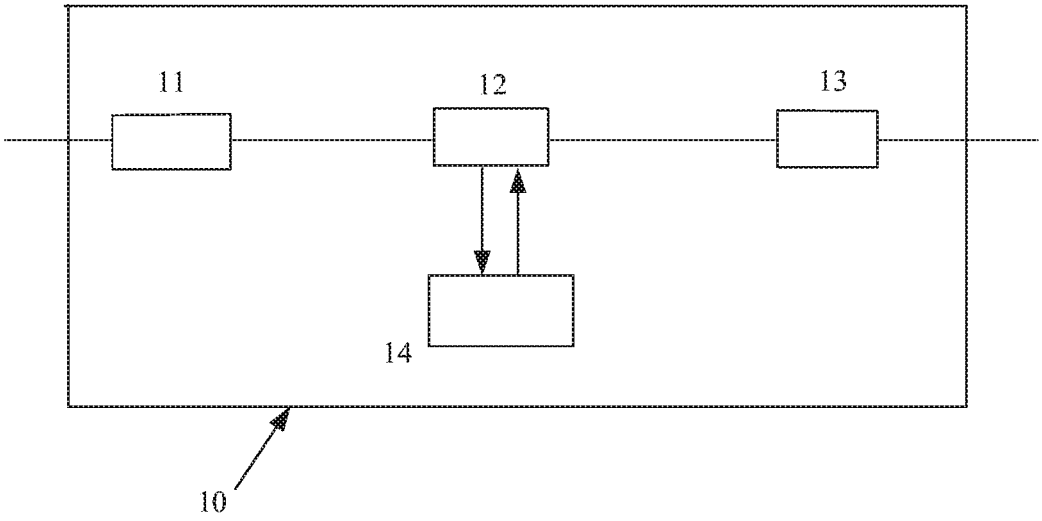
FIG. 4 illustrates an exemplary block diagram showing a control unit for generating control signals which can be used to turn on and off current sources of a driver circuit according to one embodiment of the present disclosure.

For further explanation, diagram of FIG. 4 is discussed. FIG. 4 illustrates an exemplary block diagram showing a control unit for generating control signals which can be used for turning on and off the current sources of a driver circuit according to one embodiment of the present disclosure.

The control unit 10 in FIG. 4 can output a signal for controlling on and off of the current sources (I1, I2, . . . , IX) of a driver circuit. The control unit 10 comprises an input unit 11, a processor 12 and an output unit 13. Further, the control unit 10 could comprise a mode storage 14. Although the mode storage 14 is included in the control unit 10 as shown in FIG. 4, it is not necessary for containing the mode storage 14 in the control unit 10. A wire connection or a wireless connection could be used for communication between the control unit 10 and the mode storage 14.

An input unit 11 of the control unit 10 receives an instruction from a human or from a remote source sending instructions. For one embodiment, a remote controller may send an instruction to the light apparatus, and the input unit 11 within the control unit 10 of the light apparatus receives the instruction.

In one embodiment, the input unit 11 may convert the instructions into digital codes. Then the input unit 11 may send the received instructions which have been converted into the digital codes to a processor 12. The processor 12 conducts processing on the received instructions, and selects a lighting mode from the mode storage 14 based on the received instructions. The operations conducted by the processor 12 may include selecting a mode from the mode storage 14 by looking up a corresponding lighting mode based on the received instructions. After selection of the lighting modes, the processor 12 may send the selected light mode to the output unit 13. Then the output unit 13 outputs control signals based on the selected lighting modes.

The processor 12 and the mode storage 14 may be connected in a wire connection or in a wireless connection. In one embodiment, the wireless connection may be blue tooth, zigbee or WiFi. The disclosure does not aim to limit communication approaches utilized.

The selected modes of the appearances of the light source could be a clock, a timer, an alarm or some designator with specific meaning. All above appearances are an exemplary appearances of the lighting apparatus, wherein such kind of appearance is called as a lighting language. Detailed explanation of lighting language is described by referring to FIG. 6 in following paragraphs.

Figure 5:
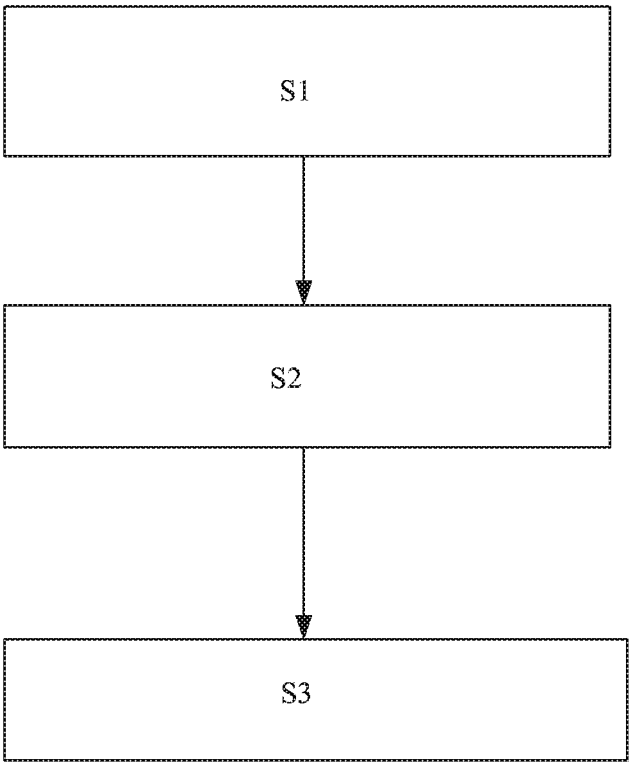
FIG. 5 illustrates a flowchart of a process for generating control signals in a control unit according to one embodiment of the present disclosure.

Next, by referring to FIG. 5, steps for generating control signals in a control unit according to one embodiment of the present disclosure is discussed.

The steps for generating control signals in a control unit 10 may include three steps. In step S1, a control unit 10 receives an instruction requiring for a specific lighting language. In step S2, a processor 12 of the control unit 10 processes the received instructions and selects a lighting mode corresponding to the received instruction. In step S3, an output unit 13 of the control unit 10 outputs control signals corresponding to the selected lighting mode. The lighting mode comprises at least one of a plurality of static lighting patterns and a plurality of dynamic lighting patterns. Therefore, the appearance of the lighting apparatus can be a static appearance or a dynamic appearance. In some embodiments, the lighting apparatus can show a sign such as a time to go to bed. In some embodiments, the lighting apparatus can show a specific message utilizing a static light emitting condition. In some embodiments, the lighting apparatus can show a timer utilizing dynamic appearance such as cycling of the on and off of the LED groups.

Figure 6:
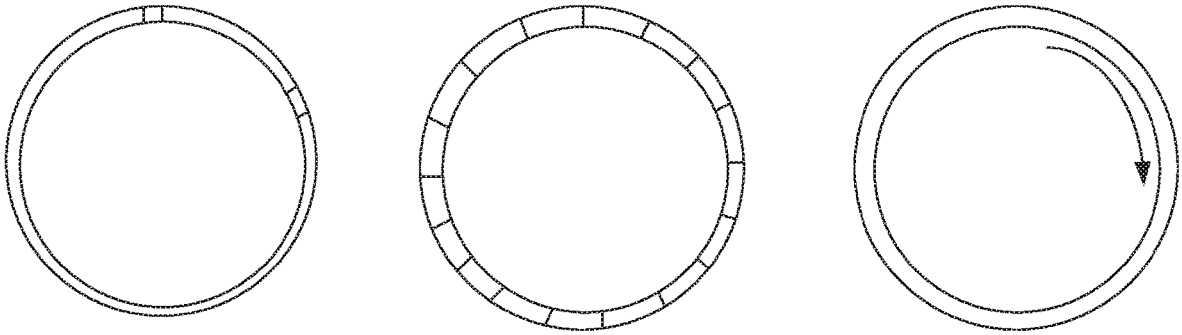
FIG. 6 illustrates exemplary appearances of the lighting apparatus when the lighting apparatus is controlled in different modes.

For easy understanding, exemplary appearances of a light apparatus are shown in FIG. 6. It illustrates exemplary appearances of the lighting apparatus when the lighting apparatus is controlled in different modes. The shape of the lighting apparatus may be a ring shape, a rectangular shape or a star shape. Any kind of shapes required can be involved into the present disclosure.

FIG. 6 shows three appearances of a lighting apparatus on the left, in the middle, and on the right of FIG. 6. The three lighting appearances render different operations and illustrate different lighting languages. These figures are drawn in an illustrative way, the appearances of the lighting apparatus are not limited by these appearances.

The appearance shown on the left of FIG. 6 is an exemplary drawing of a lighting apparatus emitting light in a clock mode. There are two blocks shown in a ring of the lighting apparatus. One block is provided at a first position (e.g. a twelve clock position), the other block is provided at a second position. When center of the ring and the two positions are connected respectively, an angle between the two lines constitutes a 60 degree angle. With this configuration, the lighting apparatus presents a lighting language meaning "2 o'clock".

The appearance shown in the middle of FIG. 6 is an exemplary drawing of a lighting apparatus emitting light in an alarm mode. All LED groups can be controlled on and off by a specific frequency, so that the lighting apparatus shines in a specific frequency. Alternating of being bright and dark can provide strong impact to a user so that he or she can receive alarm messages.

The appearance shown on the right of FIG. 6 is an exemplary drawing of a lighting apparatus emitting light in a timer mode. The LED groups of the lighting apparatus are controlled on and off in a cycling fashion. This appearance can be achieved by controlling the timing of on and off of the current source.

The lighting apparatus of FIG. 6 shows a ring shape lighting apparatus with an inner ring and an outer ring. However, the shape of the lighting apparatus is not limited to two-ring type configuration. Also, all the appearances are exemplary modes, and the appearances of the lighting apparatus can render other lighting languages rather than those shown in FIG. 6. They are shown here only for the purpose of easy understanding and should not be conceived as limiting the disclosure inappropriately.

The present disclosure provides a plurality of LED arrays which are based on red, green, blue (RGB) color mixing. The LEDs in one group form a common cathode structure, so that LED arrays could provide even brightness, or less flicker, less shift in color. Further, by virtue of even brightness and stable lighting, specific lighting languages can be rendered by the lighting apparatus. Further, the lighting apparatus can be applied in the art of smart lamp and other LED display products. In one embodiment, the lighting apparatus may be applied in the internet of things (IOT).

It is to be understood that specifics in the aforementioned examples may be used anywhere in one or more embodiments. For instance, all optional features of the electronic device described above may also be implemented with respect to either of the methods or the computer-readable medium described herein. Furthermore, although flow diagrams and/or state diagrams may have been used herein to describe embodiments, the present techniques are not limited to those diagrams or to corresponding descriptions herein. For example, flow need not move through each illustrated box or state or in exactly the same order as illustrated and described herein.

Although for the designs of the driving circuit, lighting apparatus, appearance of the lighting apparatus have been set forth in combination with specific embodiments, the person skilled in the art shall understand that many modifications and variations may be made to the present invention. Therefore, it should be recognized that the intention of the claims is to cover all these modifications and variations within the real concept and range of the present invention.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. A lighting apparatus comprising:

a plurality groups of lighting elements, wherein each group of lighting elements comprises at least one lighting element, each lighting element in a same group having a cathode connected to a common cathode node; and a driving circuit comprising a plurality of voltage sources, each having a terminal connected to an anode of a respective lighting element in each group of lighting elements; and a plurality of current sources, each having a terminal connected to the common cathode node of a respective group of lighting elements, wherein a presenting appearance of the lighting apparatus comprises a clock, a timer, an alarm, or a designator for showing waiting status, the presenting appearance achieved by controlling on and off timing of each of the plurality of current sources to control on and off of a respective group of lighting elements.

2. The lighting apparatus as recited in claim 1, wherein a voltage value of each of the plurality of voltage sources is a constant value.

3. The lighting apparatus as recited in claim 1, wherein a current value of each of the plurality of current sources is a constant value.

4. The lighting apparatus as recited in claim 1, wherein each current source is turned on and off in a Digital Signal Processing (DSP) control mode.

5. The lighting apparatus as recited in claim 1, wherein the driving circuit further comprises a control unit connected to each of the plurality of the current sources for controlling on and off of the plurality groups of lighting elements by group.

6. The lighting apparatus as recited in claim 5, wherein the control unit comprises:

an input unit for receiving an instruction;

a processor for selecting a lighting mode according to the received instruction; and an output unit for outputting control signals based on the selected lighting mode.

7. The lighting apparatus as recited in claim 6, wherein the lighting mode is selected from a plurality of lighting modes stored in a mode storage, and the lighting mode comprises at least one of a plurality of static lighting patterns and a plurality of dynamic lighting patterns.

8. The lighting apparatus as recited in claim 1, further comprising a plurality of switches, each switch corresponding to a respective one of the plurality of voltage sources, being connected between an anode of a respective lighting element of at least one group of lighting elements and the terminal of the respective one voltage source, and having its on/off status controlled with PWM signals.

9. The lighting apparatus as recited in claim 8, wherein each switch is a PMOS.

10. A driving circuit for a lighting apparatus, the lighting apparatus comprising a plurality groups of lighting elements, each group of lighting elements comprising at least one lighting element, each lighting element in a same group having a cathode connected to a common cathode node, the driving circuit comprising:

a plurality of voltage sources, each having a terminal connected to an anode of a respective lighting element in each group of lighting elements; and a plurality of current sources, each having a terminal connected to the common cathode node of a respective group of lighting elements, wherein a presenting appearance of the lighting apparatus comprises a clock, a timer, an alarm, or a designator for showing waiting status, the presenting appearance achieved by controlling on and off timing of each of the plurality of current sources of the driving circuit to control on and off of a respective group of lighting elements.

11. The driving circuit as recited in claim 10, wherein a voltage value of each of the plurality of voltage sources is a constant value.

12. The driving circuit as recited in claim 10, wherein a current value of each of the plurality of current sources is a constant value.

13. The driving circuit as recited in claim 10, wherein each current source is turned on and off in a Digital Signal Processing (DSP) control mode.

14. The driving circuit as recited in claim 10, wherein the driving circuit further comprises a control unit connected to each of the plurality of the current sources for controlling on and off of the plurality groups of lighting elements by group.

15. The driving circuit as recited in claim 14, wherein the control unit further comprises:

an input unit for receiving an instruction;

a processor for selecting a lighting mode according to the received instruction; and an output unit for outputting control signals based on the selected lighting mode.

16. The driving circuit as recited in claim 15, wherein the lighting mode is selected from a plurality of lighting modes stored in a mode storage, and the lighting mode comprises at least one of a plurality of static lighting patterns and a plurality of dynamic lighting patterns.

17. A driving method used for a lighting apparatus, the lighting apparatus comprising a plurality groups of lighting elements and a driving circuit, each group of lighting elements comprising at least one lighting element, each lighting element in a same group having a cathode connected to a common cathode node, the driving circuit comprising a plurality of voltage sources and a plurality of current sources, each of the plurality of voltage sources having a terminal connected to an anode of a respective lighting element in each group of lighting elements, each of the plurality of current sources having a terminal connected to the common cathode node of a respective group of lighting elements, the driving method comprising:

providing a constant voltage by each of the plurality of voltage sources;

providing a constant current by each of the plurality of current sources; and turning on and off each current source to control a respective group of lighting elements to achieve a presenting appearance of the lighting apparatus that comprises a clock, a timer, an alarm, or a designator for showing waiting status.

18. The driving method as recited in claim 17, wherein each current source is turned on and off in a Digital Signal Processing (DSP) control mode.

19. The driving method as recited in claim 17, wherein said turning on and off each current source to control a respective group of lighting elements comprises:

receiving an instruction;

selecting a lighting mode according to the received instruction; and outputting control signals based on the selected lighting mode.

20. The driving method as recited in claim 17, wherein the driving circuit further comprises a control unit connected to each of the plurality of the current sources for controlling on and off of the plurality groups of lighting elements by group; wherein the control unit comprises: an input unit for receiving an instruction; a processor for selecting a lighting mode according to the received instruction; and an output unit for outputting control signals based on the selected lighting mode; and wherein the lighting mode is selected from a plurality of lighting modes stored in a mode storage, and the lighting mode comprises at least one of a plurality of static lighting patterns and a plurality of dynamic lighting patterns.

* * * * *